United States Patent [19]

Mayer et al.

[11] 3,991,257

[45] Nov. 9, 1976

[54] PROCESS FOR FLAMEPROOFING ORGANIC FIBRE MATERIAL BY THE TRANSFER PROCESS

[75] Inventors: Fritz Mayer, Haltingen, Germany; Jörg Kern, Oberwil; Hermann Nachbur, Dornach, both of Switzerland

[73] Assignee: Ciba-Geigy AG, Basel, Switzerland

[22] Filed: June 18, 1974

[21] Appl. No.: 480,338

[30] Foreign Application Priority Data

June 22, 1973 Switzerland ..... 9187/73
July 26, 1973 Switzerland ..... 10927/73

[52] U.S. Cl. ..... 428/921; 8/2.5 A; 101/470; 427/248 R

[51] Int. Cl.[2] ..... C23C 11/00; C09K 3/28

[58] Field of Search ..... 117/136; 252/8.1; 106/15 FP; 427/390, 394, 248; 8/2.5 A; 156/230; 101/470; 428/921

[56] References Cited

UNITED STATES PATENTS

| | | | |
|---|---|---|---|
| 3,559,317 | 2/1971 | Knight et al. | 117/3.2 |
| 3,645,936 | 2/1972 | Gardner | 117/136 |
| 3,650,820 | 3/1972 | DiPietro et al. | 117/136 |
| 3,660,582 | 5/1972 | DiPietro et al. | 117/136 |
| 3,666,402 | 5/1972 | Meyers et al. | 117/136 |
| 3,707,346 | 12/1972 | Markert et al. | 8/2.5 |
| 3,715,310 | 2/1973 | Butcher | 117/136 |
| 3,915,628 | 10/1975 | Bossard et al. | 8/2.5 |

FOREIGN PATENTS OR APPLICATIONS

| | | |
|---|---|---|
| 1,243,219 | 8/1971 | United Kingdom |

*Primary Examiner*—Michael R. Lusignan
*Attorney, Agent, or Firm*—Joseph G. Kolodny; Edward McC. Roberts; Prabodh I. Almaula

[57] ABSTRACT

A process for flameproofing organic fiber material by the dry thermal transfer process is provided. In this process, a preparation is applied to an inert carrier which is then brought into contact with the fiber materials, especially polyamide, polyacrylonitrile or linear polyester fibers; thereafter the carrier and the material to be finished are subjected to a heat treatment at not less than 80° C and the finished material is then separated from the carrier.

The preparation which is applied in this process contain a phosphorus compound of the formula

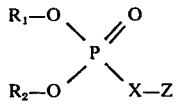

wherein $R_1$ and $R_2$ are alkyl or halogenoalkyl, X is oxygen or —NH— and Z is hydrogen, alkyl, hydroxyalkyl, halogenoalkyl, alkenyl or acyloxyalkyl.

11 Claims, No Drawings

PROCESS FOR FLAMEPROOFING ORGANIC FIBRE MATERIAL BY THE TRANSFER PROCESS

The subject of the invention is a process for flameproofing organic fibre material by the dry thermal transfer process, characterised in that a preparation which contains at least a. a phosphorus compound of the formula

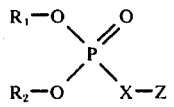

(1)

wherein $R_1$ and $R_2$ each denote alkyl or halogenoalkyl, each with 1 to 6 carbon atoms, X denotes oxygen or —NH— and Z denotes hydrogen, alkyl, hydroxyalkyl, halogenoalkyl or alkenyl with at most 6 carbon atoms or acyloxyalkyl with 1 to 6 carbon atoms in the alkyl radical, and wherein acyl denotes the radical of an aliphatic monocarboxylic acid with at most 5 carbon atoms, b. optionally a binder which is stable below 250° C and c. optionally a solvent is applied to an inert carrier and is optionally dried, the carrier is then brought into contact with the surface of the fibre material which is to be flameproofed, thereafter the carrier and the material to be finished are subjected to a heat treatment at not less than 80° C, if appropriate with use of mechanical pressure, until the phosphorus compound has been transferred to the fibre material, and the finished material is then separated from the carrier.

Preferably, the component (a) used is a phosphorus compound of the formula

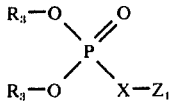

(2)

wherein $R_3$ denotes halogenoalkyl with 1 to 4 carbon atoms and 1 to 4 halogen atoms, X denotes oxygen or —NH— and $Z_1$ denotes hydroxyalkyl or halogenoalkyl each with 1 to 4 carbon atoms or acyloxyalkyl with 1 to 4 carbon atoms in the alkyl radical and wherein acyl denotes an optionally halogen-substituted alkenoyl radical with 3 or 4 carbon atoms.

Particularly suitable components (a) are phosphorus compounds of the formula

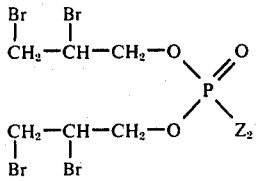

(3)

wherein $Z_2$ denotes hydroxyl, 2,3-dibromo-n-propoxy, 2-hydroxyethylamino or methacrylethoxy.

The compounds of the formula (1) are, for example, phosphorous compounds of the formula (4.1) 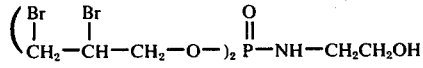

(4.2) 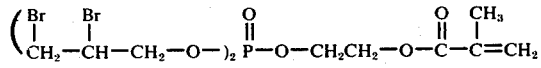

(4.3) 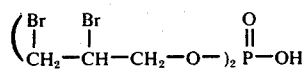

(4.4) 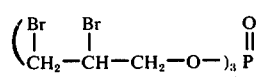

The compounds of the formula (4.2) and (4.4) are preferred particularly.

The radicals $R_1$, $R_2$ and Z can represent alkyl or halogenoalkyl (with 1 to 3 halogen atoms) with 1 to 6, preferably 1 to 4, carbon atoms, such as, for example, n-hexyl, n-pentyl, tert.-butyl, n-butyl, isopropyl, n-propyl, ethyl, methyl, chloromethyl, bromomethyl, 2-bromoethyl, 2,3-dibromo-n-propyl, 3-bromo-n-propyl, 2,2,3-tribromo-n-propyl, 2-chloro-2,3-dibromo-n-propyl and the like. Preferably, halogen represents chlorine or, in particular, bromine. Z can also represent hydroxyl with 1 to 6, preferably 1 to 4, carbon atoms, for example, methylol, hydroxyethyl or 4-hydroxybutyl. Alkenyl Z can be radicals with 2 to 6, especially 2 to 4, carbon atoms, such as, for example allyl or 2,3-butenyl. The acyloxyalkyl radicals in the definition of Z are radicals of esters, containing hydroxyl groups, of monocarboxylic acids with dialkanols, with the acid part being derived, for example, from acrylic, methacrylic, vinylacetic, butyric, propionic or acetic acid, whilst the alcohol part is above all derived from glycols such as ethylene glycol, propylene glycol or butylene glycol.

The compounds of the formula (1) are in themselves known or are manufactured according to known methods.

In addition to the flameproofing agent of the formula (1) which is transferred onto the fibre material, the preparations used according to the process can also contain at least one binder which is stable below 250° C, water and/or an organic solvent.

Suitable binders are synthetic, semi-synthetic and natural resins, and in particular both polycondensation and polyaddition products. In principle, all binders customary in the lacquer and printing ink industry can be used. The binders serve to retain the phosphorus compounds of the formula (1) on the treated position of the carrier. At the transfer temperature they should, however, not melt, not react with themselves, for example crosslink, and be capable of releasing the compound to be transfered. Preferred binders are those which, for example, dry rapidly in a warm stream of air and form a fine, preferably non-tacky, film on the carrier. As examples of suitable water-soluble binders there may be mentioned: alginate, tragacanth, carubin (from carob bean flour), dextrin, etherified or esterified vegetable mucins, carboxymethylcellulose or polyacrylamide, whilst as binders soluble in organic solvents there may be mentioned cellulose esters, such as nitrocellulose or cellulose acetate and especially cellulose ethers, such as methylcellulose, ethylcellulose, propylcellulose, isopropylcellulose, benzylcellulose or hydroxyethylcellulose as well as their mixtures. Particularly good results are achieved with ethylcellulose.

As organic solvents it is possible to use water-miscible or water-immiscible organic solvents or solvent mixtures of boiling point below 150° C, preferably below 120° C, under normal pressure. Advantageously, aliphatic, cycloaliphatic or aromatic hydrocarbons, such as toluene, cyclohexane, or petroleum ether, lower alkanols, such as methanol, ethanol, propanol, isopropanol, esters of aliphatic monocarboxylic acids, such as ethyl acetate or propyl acetate, aliphatic ketones, such as methyl ethyl ketone and halogenated aliphatic hydrocarbons, such as perchloroethylene, trichloroethylene, 1,1,1-trichloroethane or 1,1,2-trichloro-2,2,1-trifluoroethylene are used. Particularly preferred solvents are lower aliphatic esters, ketones or alcohols, such as butyl acetate, acetone, methyl ethyl ketone, isopropanol, butanol or above all ethanol, as well as their mixtures, for example a mixture of methyl ethyl ketone and ethanol in the ratio of 1:1. The desired viscosity of the printing pastes can then be obtained by adding the stated binders together with a suitable solvent.

The weight ratio of the individual components in the preparation can vary greatly and is, for example, from 20 to 100 per cent by weight in the case of the compounds of the formula (1), from 0 to 30 per cent by weight in the case of the binder, and from 0 to 70 per cent by weight in the case of water or the organic solvent or solvent mixture, relative to the total weight of the preparation. The amounts of compound, to be transferred to the fibre material, applied to the temporary carrier can be, for example, 10 to 100 g, preferably 20 to 50 g, per $m^2$ of carrier.

The preparations used according to the invention are prepared by dissolving or finely dispersing the phosphorus compound of the formula (1) in water and/or organic solvent, advantageously in the presence of a binder which is stable below 250° C.

Further, it is also possible to apply compounds of the formula (1) directly as such onto the carrier, that is to say without solvents or binder, for example by sprinkling, doctoring, pouring, spraying or padding.

The process according to the invention is suitably carried out by applying the preparation to an inert temporary carrier, bringing the treated side of the carrier into contact with the fibre material which is to be treated, subjecting the carrier and the fibre material to the action of heat at not less than 80° C, preferably not less than 130° C, and separating the fibre material from the carrier.

The temporary carrier required in accordance with the process can be endless or be matched to the textile shapes which are to be treated, that is to say cut into shorter or longer pieces. As a rule it has no affinity for the preparation used. Suitably, the carrier is a flexible, preferably dimensionally stable, band, a strip or a film, preferably having a smooth surface, which is stable to heat and can consist of materials of the most diverse kind, for example metal, such as an aluminium foil or steel foil, plastic, paper or textile sheet-like structures, such as woven fabrics, knitted fabrics or fleeces which are optionally coated with a film of vinyl resin, ethylcellulose, polyurethane resin or polytetrafluoroethylene. Suitably, a needle-punched felt of polytetrafluoroethylene fibres or flexible aluminium foils, sheets of glass fibre fabric or above all sheets of paper are used.

After the preparations have been applied to the carrier, they are dried, for example by means of a warm stream of air or by infra-red irradiation, the solvent used optionally being recovered.

The treated side of the carrier is thereupon brought into close contact with the surface of the fibre material to be treated, and the combination is subjected to a heat treatment at not less than 80° C and preferably 150° to 220° C, particularly 150° to 200° C.

These temperatures are maintained for a sufficient period of time, preferably 5 to 120 seconds, until the phosphorus compounds of the formula (1) have been transferred to the fibre material to be treated.

Changes in temperature and in time can result in corresponding changes in the amount of coating for the same chemicals presented. It is therefore possible to regulate the transfer of the chemicals to the fibre material, and hence the amount of coating, through regulating the temperature and the transfer time.

The exposure to heat can be effected in various known ways, for example by means of a heating plate or by passing through a tunnel-shaped heating zone or over a hot heating drum, advantageously in the presence of an unheated or heated counter-roller which exerts pressure, or through a hot calendar, or by means of a heated plate (iron or warm press) optionally in vacuo, the heating devices being preheated to the requisite temperature by steam, oil or infra-red radiation or being located in a preheated chamber. After completion of the heat treatment, the textile goods are separated from the carrier.

Preferably, synthetic fibre materials are treated, such as, for example, cellulose ester fibres, cellulose 2½-acetate and triacetate fibres, synthetic polyamide fibres, for example those from poly-ε-caprolactam (nylon 6), from poly-ω-aminoundecanoic acid (nylon 7) or especially from polyhexamethylenediamine adipate (nylon 6,6), polyurethane or polyolefine fibres, for example polypropylene fibres, acid-modified polyamides, such as polycondensation products of 4,4'-diamino-2,2'-diphenyldisulphonic acid or 4,4'-diamino-2,2'-diphenylalkanedisulphonic acids with polyamide-forming starting materials, polycondensation products of monoaminocarboxylic acids or their amide-forming derivatives or of dibasic carboxylic acids and diamines with aromatic dicarboxysulphonic acids, for example polycondensation products of ε-caprolactam or hexamethylenediammonium adipate with potassium 3,5-dicarboxybenzenesulphonate, or acid-modified polyester fibres, such as polycondensation products of aromatic polycarboxylic acids, for example terephthalic acid or isophthalic acid, polyhydric alcohols, for example ethylene glycol and 1,2- or 1,3-dihydroxy-3-(3-sodium sulphopropoxy-propane, 2,3-dimethylol-1-(3-sodium-sulphopropoxy)-butane, 2,2-bis-(3-sodium-sulphopropoxyphenyl)-propane or 3,5-dicarboxybenzenesulphonic acid or sulphonated terephthalic acid, sulphonated 4-methoxybenzenecarboxylic acid or sulphonated diphenyl-4,4′-dicarboxylic acid.

Preferably, however, fibre material of polyacrylonitrile or acrylonitrile copolymers and above all linear polyester fibres, especially of polyethylene glycol terephthalate or poly-(1,4-cyclohexanedimethylol) terephthalate, are used. If acrylonitrile copolymers are used, the proportion of acrylonitrile is suitably at least 50% and preferably at least 85 per cent by weight of the copolymer. The comonomers used are normally other vinyl compounds, for example vinylidene chloride, vinylidene cyanide, vinyl chloride, methacrylate, methylvinylpyridine, N-vinylpyrrolidone, vinyl acetate, vinyl alcohol, acrylamide or styrenesulphonic acids.

These fibre materials can also be used as mixed fabrics, the fibre materials being mixed with one another or with other fibres, examples being mixtures of polyacrylonitrile/polyester, polyamide/polyester, polyester/viscose and polyester wool.

The fibre material can be in the most diverse states of processing, for example in the form of flocks, tow, yarn, texturised filaments, woven fabrics, knitted fabrics, fibre fleeces or textile floor coverings, such as needle-punched felt carpets, pile carpets or bundles of yarns.

The preparations which can be used according to the invention are applied to the temporary carrier by, for example, whole-area or partial spraying, coating or printing.

The temporary carriers can also be treated on both sides or, if appropriate, on the back, and unequal concentrations of the coatings can be selected for the two sides.

EXAMPLE 1

750 g of the product of the formula (4.4) in 100 g of ethylcellulose and 350 g of a 1:1 mixture of ethanol and methyl ethyl ketone are converted to a paste and 24 or 48 g/m² are coated onto paper.

The coated side of the carrier is brought into contact with a polyester knitted fabric (240 g/m²) and the combination is subjected to a heat treatment at 195° C between two heating plates for 25 seconds. The carrier and the knitted fabric are then separated from one another.

The knitted fabrics are then tested for their flame resistance in accordance with DOC FF 3-71 ("Children's Sleepwear Test"), the test being carried out after the finishing treatment and also after 1, 5, 10, 20 and 40 use-type washes at 40° C in a liquor containing 4 g/l of a commercial detergent for delicate fabrics.

The result is summarised in Table 1 which follows.

Instead of the compound of the formula (4.4), a compound of the formula (4.1), (4.2) or (4.3) can be employed with comparable success.

DOC 3-71 ("Children's Sleepwear test") is the following flameproofing test:

5 pieces of fabric (8.9 × 25.4 cm) are clamped in a test frame and dried for 30 minutes at 105° C in a circulating air drying cabinet. The pieces of fabric are subsequently conditioned for 30 minutes in a closed vessel over silica gel and then subjected to the actual flameproofing test in a burning box. The fabrics are each ignited for 3 seconds with a methane gas flame, the fabrics being in the vertical position.

The test is considered to have been withstood if the average charred zone is not longer than 17.5 cm and not a single sample has a charred zone of more than 25.4 cm and the individual smouldering times are not longer than 10 seconds.

EXAMPLE 2

The compound of the formula (4.4), in the form of a thick viscous liquid is uniformly spread by means of a doctor blade onto an aluminium foil so as to produce a coating of 50 g/m².

The coated side of the aluminium foil is brought into contact with a polyamide-6,6 knitted fabric and the combination is subjected to a heat treatment at 195° C between two heating plates for 30 seconds. The carrier and the knitted fabric are then separated from one another.

The flame-resistance of the knitted fabric treated in this way is tested in comparison with untreated knitted fabric in accordance with DOC FF 3-71, the results being summarised in Table 2 below:

Table 2

| | Burning time in seconds | Tear length in cm |
|---|---|---|
| Knitted fabric treated with the compound of the formula (4.4) | 7 | 6 |
| Untreated knitted fabric | 20 | Burns away completely |

EXAMPLE 3

750 g of the compound of the formula (4.2) are transferred, exactly as indicated in Example 1, onto a previously chromed knitted fabric of polyamide 6,6 (240 g/m²) and onto a woven polyester fabric (250 g/m²).

The flame-resistance of the knitted and woven fabrics treated in this way, in comparison with untreated knitted fabric and woven fabric respectively, is tested Table 1

| | Coating g/m² | Tested: After finishing TL | After finishing BT | After 1 wash TL | After 1 wash BT | After 5 washes TL | After 5 washes BT | After 10 washes TL | After 10 washes BT | After 20 washes TL | After 20 washes BT | After 40 washes TL | After 40 washes BT |
|---|---|---|---|---|---|---|---|---|---|---|---|---|---|
| Untreated | | 12 | 22 | 4 | 9 | 10 | 25 | 4 | 19 | Burns | 28 | 6 | 15 |
| Treated with the compound of the formula (4.4) | 24 | 6 | 10 | 4 | 2 | 4.5 | 6 | 6 | 13 | 5 | 1 | 4.5 | 4.5 |
| (4.4) | 48 | 7 | 2 | 3.5 | 1 | 6 | 4 | 6 | 4 | 4 | 1 | 6 | 6 |

TL: Tear length in cm
BT: Burning time in seconds according to DOC FF 3-71, the results being summarised in Table 3 below.

Table 3

| | Burning time in seconds | Tear length in cm |
|---|---|---|
| Polyamide knitted fabric treated with the compound of the formula (4.2) | 8 | 6 |
| Untreated polyamide knitted fabric | 30 | Burns away completely |
| Polyester woven fabric treated with the compound of the formula (4.2) | 3 | 6 |
| Untreated polyester woven fabric | 20 | Burns away completely |

EXAMPLE 4

The compound of the formula (4.2), as a thin viscous liquid, is uniformly padded onto a needle-punched felt of polytetrafluoroethylene fibres (300 g/m$^2$) so that a coating of 60 g/m$^2$ results. The coated side of the needle-punched felt of polytetrafluoroethylene fibres is brought into contact with the pile side of a polyacrylonitrile fibre carpet and the combination is subjected to the action of heat at 165° C, from the uncoated side of the needle-punched felt of polytetrafluoroethylene fibres, for 1 minute on a heating plate. The needle-punched felt is then separated from the carpet.

The flame-resistance of the polyacrylonitrile carpet treated in this way in comparison with an untreated carpet is tested according to DIN 51,960, the results being summarised in Table 4 which follows:

Table 4

| | Burning length in cm | Burning time in seconds |
|---|---|---|
| Treated carpet | 4.5 | 2 |
| Untreated carpet | Burns away completely | 5 |

EXAMPLE 5

200 g of the compound of the formula (4.1 ) are dissolved in 800 ml of ethanol and padded onto a glass fibre fabric (260 g/m$^2$), the liquor uptake being so chosen that after evaporation of the ethanol at approx. 80° C, a 25 g/m$^2$ coating of the compound of the formula (4.1 ) results.

The impregnated glass fibre fabric is brought into contact with a pre-chromed knitted fabric of polyamide-6,6 or with a polyester woven fabric and the combination is subjected to the action of heat at 195° C between two heating plates for 30 seconds. The polyamide knitted fabric or polyester woven fabric is then separated from the glass fibre fabric.

The flame resistance of the polyamide knitted fabric or polyester woven fabric treated in this way is tested in comparison with untreated knitted fabric or woven fabric, respectively, in accordance with DOC FF 3-71. The results are summarised in Table 5 which follows:

Table 5

| | Burning time in seconds | Tear length in cm |
|---|---|---|
| Polyamide knitted fabric treated with the compound of the formula (4.1) | 12 | 12.5 |
| Untreated polyamide knitted fabric | 30 | Burns away completely |

Table 5-continued

| | Burning time in seconds | Tear length in cm |
|---|---|---|
| Polyester woven fabric treated with the compound of the formula (4.1) | 8 | 6 |
| Untreated polyester woven fabric | 20 | Burns away completely |

We claim:

1. Process for flameproofing organic fiber material by the dry thermal transfer process which comprises applying to an inert carrier a preparation containing a phosphorus compound of the formula

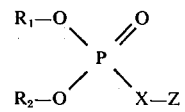

wherein $R_1$ and $R_2$ each are alkyl or halogenoalkyl, each with 1 to 6 carbon atoms, X is oxygen or —NH— and Z is hydrogen, alkyl, hydroxyalkyl, halogenoalkyl or alkenyl with at most 6 carbon atoms or acyloxyalkyl with 1 to 6 carbon atoms in the alkyl radical, and wherein acyl is the radical of an aliphatic monocarboxylic acid with at most 5 carbon atoms, then bringing the carrier into contact with the surface of the fiber material which is to be flameproofed, thereafter subjecting the carrier and the material to be finished to a heat treatment at 150° to 220° C until the phosphorus compound has been transferred to the fiber material, and then separating the finished material from the carrier.

2. Process according to claim 1 which comprises applying a preparation containing a phosphorus compound of the formula

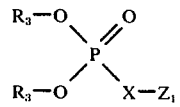

wherein $R_3$ is halogenoalkyl with 1 to 4 carbon atoms and 1 to 4 halogen atoms, X is oxygen or —NH— and $Z_1$ is hydroxyalkyl or halogenoalkyl each with 1 to 4 carbon atoms or acyloxyalkyl with 1 to 4 carbon atoms in the alkyl radical and wherein acyl is a member selected from the group consisting of halogen-substituted and unsubstituted alkenoyl radicals with 3 or 4 carbon atoms.

3. Process according to claim 2 comprising applying a preparation containing a phosphorus compound of the formula

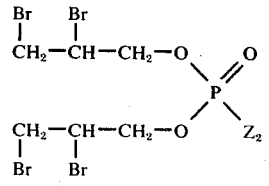

wherein $Z_2$ is hydroxyl, 2,3-dibromo-n-propoxy, 2-hydroxyethylamino or methacrylethoxy.

4. Process according to claim 3 which comprises applying a preparation containing a phosphorus compound of the formula

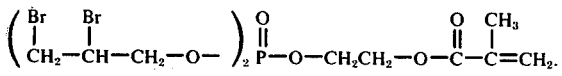

5. Process according to claim 3 which comprises applying a preparation containing a phosphorus compound of the formula

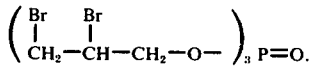

6. Process according to claim 3 which comprises applying a preparation containing a phosphorus compound of the formula

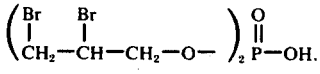

7. Process according to claim 3 which comprises applying a preparation containing a phosphorus compound of the formula

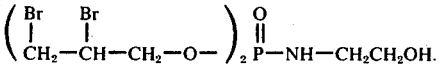

8. Process according to claim 1 which comprises applying a preparation containing in addition to the phosphorus compound a binder which is stable below 250° C and an organic solvent.

9. Process according to claim 1 which comprises applying a preparation containing from 20 to 100 per cent by weight of the phosphorus compound, 0 to 30 per cent by weight of a binder which is stable below 250° C and 0 to 70 per cent by weight of an organic solvent.

10. Process according to claim 1 which comprises flameproofing polyamide fibers, polyacrylonitrile fibers or linear polyester fibers.

11. The organic fibre material bearing thereon a flameproof finish applied according to the process of claim 1.

* * * * *